US010801708B1

(12) United States Patent
Morris et al.

(10) Patent No.: US 10,801,708 B1
(45) Date of Patent: Oct. 13, 2020

(54) QUICK MOUNTING YOKE FOR AN LED LIGHTING DEVICE

(71) Applicant: SIGNIFY HOLDING B.V., Eindhoven (NL)

(72) Inventors: Tyler Brian Morris, Liverpool, NY (US); Walten Peter Owens, Chittenango, NY (US); Khurram Moghal, Senoia, GA (US)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/694,075

(22) Filed: Nov. 25, 2019

(51) Int. Cl.

| | |
|---|---|
| ***F21V 21/26*** | (2006.01) |
| ***F21V 17/12*** | (2006.01) |
| ***F21V 21/30*** | (2006.01) |
| ***F21Y 115/10*** | (2016.01) |

(52) U.S. Cl.
CPC ..... *F21V 21/26* (2013.01); *F21V 17/12* (2013.01); *F21V 21/30* (2013.01); *F21Y 2115/10* (2016.08)

(58) Field of Classification Search
CPC ..... F21V 21/26; F21V 21/28; F21V 21/29; F21V 21/30
See application file for complete search history.

(56) References Cited

U.S. PATENT DOCUMENTS

| | | | | |
|---|---|---|---|---|
| 6,190,023 | B1 * | 2/2001 | Leadford | F21V 7/048 362/263 |
| 7,770,858 | B2 * | 8/2010 | Fehrenbach | F16M 13/02 248/291.1 |
| 8,337,058 | B2 | 12/2012 | Gordin et al. | |
| 8,960,976 | B2 * | 2/2015 | Georgitsis | F21V 21/30 362/419 |
| 9,494,306 | B1 | 11/2016 | Newton | |
| 2016/0338156 | A1 * | 11/2016 | Casper | F21V 23/02 |
| 2017/0184261 | A1 * | 6/2017 | Casper | F21V 23/02 |
| 2017/0184298 | A1 * | 6/2017 | Casper | F21V 15/01 |

* cited by examiner

*Primary Examiner* — Alexander K Garlen
(74) *Attorney, Agent, or Firm* — Akarsh P. Belagodu

(57) ABSTRACT

This document describes a mounting structure that is used to pivotally mount and orient a lighting device with respect to a support structure. The light fixture includes an interface plate having at least one tilt aperture. Each tilt aperture corresponds to a tilt angle of the light fixture. The mounting structure includes a mounting slot for engaging with a mounting element of the interface plate, along with a semi-circular slot that overlaps the at least one tilt aperture when the light fixture is pivotally mounted on the mounting structure. The mounting structure also includes a fastening device that, when routed through the semi-circular slot for insertion into the tilt aperture, orients the light fixture pivotally mounted on the mounting structure at a tilt angle. The fastening device is lockably engaged within the semi-circular slot at a position corresponding to the tilt angle.

18 Claims, 8 Drawing Sheets

QUICK MOUNTING YOKE FOR AN LED LIGHTING DEVICE

BACKGROUND

The advent of light emitting diode (LED) based luminaires (e.g., light fixtures) has provided sports arenas, stadiums, other entertainment facilities, and other commercial and industrial facilities the ability to achieve instant on-off capabilities, intelligent controls and adjustability while delivering excellent light quality, consistent light output, and improved energy efficiency.

A luminaire is a lighting unit that includes an LED lamp or lamps together with components designed to connect the LED lamps to a power supply, to distribute the light, to position the LED lamps, and to protect the LED lamps. A luminaire is often individually oriented in reference to certain unique points on or near the field or target to be lighted, such that its orientation is pre-determined to attempt to meet intensity and uniformity minimums across the field or target. In lighting applications that use a plurality of controlled concentrated beams at different positions and angles relative to a target area, each lamp of the luminaires for the target area should be precisely aimed to a specific point on the target area. For a desired light output, each lamp of a luminaire, therefore, needs to be installed in relatively pre-determined orientation(s) or direction(s). Specifically, each individual lamp of a luminaire may need to be installed and aimed individually, and/or may need be positioned and aimed as part of a lighting design plan and thus placed in a specific location relative to the fixture and/or the other light sources, the fixture itself being oriented on site according to the lighting design plan.

One way to aim or orient such device(s) to its/their desired installed position is to erect the supporting structure for the luminaire, and then elevate a worker to the level of the lamp(s). Each lamp is then manually adjusted to some approximate orientation by the elevated worker. Alternatively, some method can be devised to find or measure relative to the predetermined orientation. In any event, it is usually difficult for one worker to adjust, aim, and then lock in correct orientation relatively large and cumbersome devices when elevated high in the air or when standing high on a tower. This is especially true if outdoors. Wind, precipitation, or other outside environment factors can make this work very difficult. This would use up substantial amounts of time and labor. It usually would require much trial and error. Human error enters into these methods. Additionally, the precise orientation of the devices is difficult to achieve with tools and methods commonly available to field workers.

To reduce field installation time and improve the accuracy of the device orientation or aiming, a preliminary orientation may be set by the manufacturer prior to shipment. This is generally a good practice since the manufacturer or designer of the system understands the needs of the device aiming better than the installation crew. However, accurate preliminary aiming at the manufacturer or assembler can be challenging. Any errors introduced during assembly are often compounded by additional errors during installation. In addition, variances in manufacturing process, personnel and components can also interject errors in the device orientation.

This document describes systems and methods that are directed to solving the issues described above, and/or other problems.

SUMMARY

In various embodiments, a lighting device includes a light fixture having a housing that contains one or more light emitting diode (LED) modules. The fixture also includes an interface plate comprising at least one tilt aperture adjacent to one or more end points of a tilt axis of the light fixture. Each tilt aperture corresponds to a tilt angle of the light fixture. The lighting device also includes a mounting structure for pivotally mounting the light fixture. The mounting structure includes a mounting slot for engaging with a mounting element of the interface plate, along with a semi-circular slot that overlaps the at least one tilt aperture when the light fixture is pivotally mounted on the mounting structure. The mounting structure also includes a fastening device that, when routed through the semi-circular slot for insertion into the tilt aperture, orients the light fixture pivotally mounted on the mounting structure at a tilt angle. The fastening device is lockably engaged within the semi-circular slot at a position corresponding to the tilt angle.

In some embodiments, the mounting structure described above and below may stand on its own for use with a lighting device.

In some embodiments, the mounting structure also includes a first mounting arm that is pivotally connected to a first side of the light fixture, a second mounting arm that is connected to a second side of the light fixture, and a base that connects the first mounting arm to the second mounting arm. The base is configured to attach the lighting device to a support structure, optionally such that the lighting device may rotate with respect to the support structure. Optionally, the mounting structure may include a locking plate affixed to an outside surface of either the first mounting arm or the second mounting arm. Optionally, the locking plate may include a pointer for identifying the tilt angle of the light fixture pivotally mounted on the mounting structure by pointing to an angular scale included in the corresponding mounting arm.

In some embodiments, the mounting structure may extend beyond the rear section of the housing. In some embodiments, the fastening device may comprise a spring pin. In some embodiments, the light fixture further may include a power supply unit, and if so the interface plate may be sandwiched between the housing and the power supply unit. In some embodiments, the mounting slot may be a U-shaped slot. The mounting element that is received by the mounting slot may include, for example: a rod-shaped protrusion formed in the interface plate at an end point of the tilt axis of the light fixture; or a bolt inserted into a mounting aperture formed in the interface plate at an end point of the tilt axis of the light fixture.

In other embodiments, a method for pre-aiming a lighting device includes mounting a light fixture of a lighting device on a mounting structure, and routing a fastening device through a semi-circular slot in the mounting structure for insertion into one of a plurality of tilt apertures included in an interface plate of the light fixture. Each of the plurality of tilt apertures corresponds to a tilt angle of the light fixture.

DETAILED DESCRIPTION

As used in this document, the singular forms "a," "an," and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to." When used in this document, the term "exemplary" is intended to mean "by way of example" and is not intended to indicate that a particular exemplary item is preferred or required.

In this document, when terms such "first" and "second" are used to modify a noun, such use is simply intended to distinguish one item from another, and is not intended to require a sequential order unless specifically stated. The term "approximately," when used in connection with a numeric value, is intended to include values that are close to, but not exactly, the number. For example, in some embodiments, the term "approximately" may include values that are within +/−10 percent of the value.

In this document, the terms "luminaire," "light fixture," "illumination device" and "lighting device" are used interchangeably to refer to a device that includes a source of optical radiation. Sources of optical radiation may include, for example, light emitting diodes (LEDs), light bulbs, ultraviolet light or infrared sources, or other sources of optical radiation. In the embodiments disclosed in this document, the optical radiation emitted by a luminaire includes visible light. A luminaire will also include a housing, one or more electrical components for conveying power from a power supply to the device's optical radiation source, and optionally control circuitry (e.g., driver circuits). In this document, the terms "driver," "driver casing," "LED driver circuit" and "driver device" are used interchangeably to refer to a device that includes a circuit to control the voltage from a power supply to an illumination device (i.e., an LED).

When used in this document, terms such as "top" and "bottom," "upper" and "lower", "inner" and "outer", or "front" and "rear," are not intended to have absolute orientations but are instead intended to describe relative positions of various components with respect to each other. For example, a first component may be an "upper" component and a second component may be a "lower" component when a device of which the components are a part is oriented in a first direction. The relative orientations of the components may be reversed, or the components may be on the same plane, if the orientation of the structure that contains the components is changed. The claims are intended to include all orientations of a device containing such components.

Figure 1A:
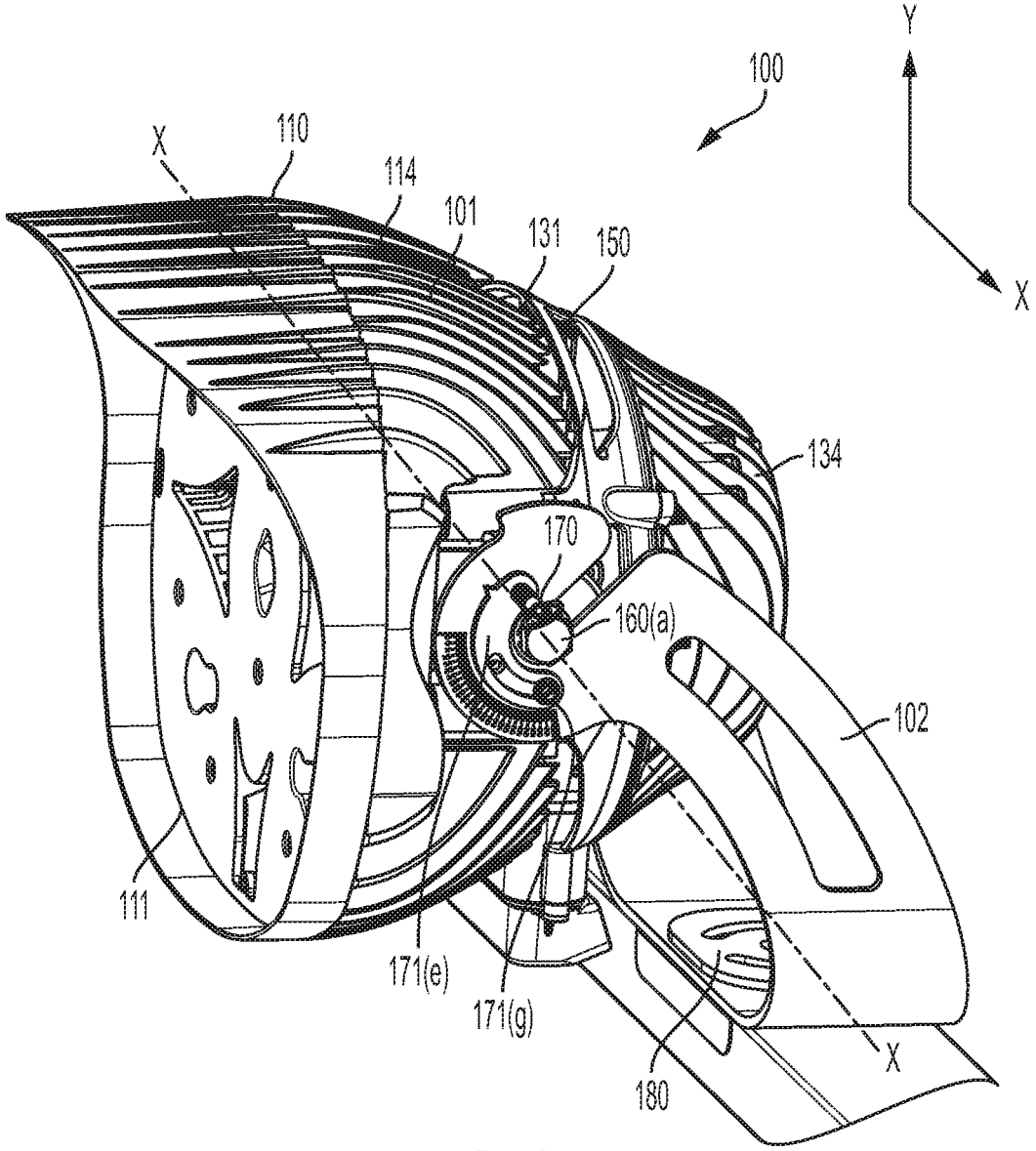
FIG. 1A illustrates a left perspective view of an example lighting device.
Figure 1B:
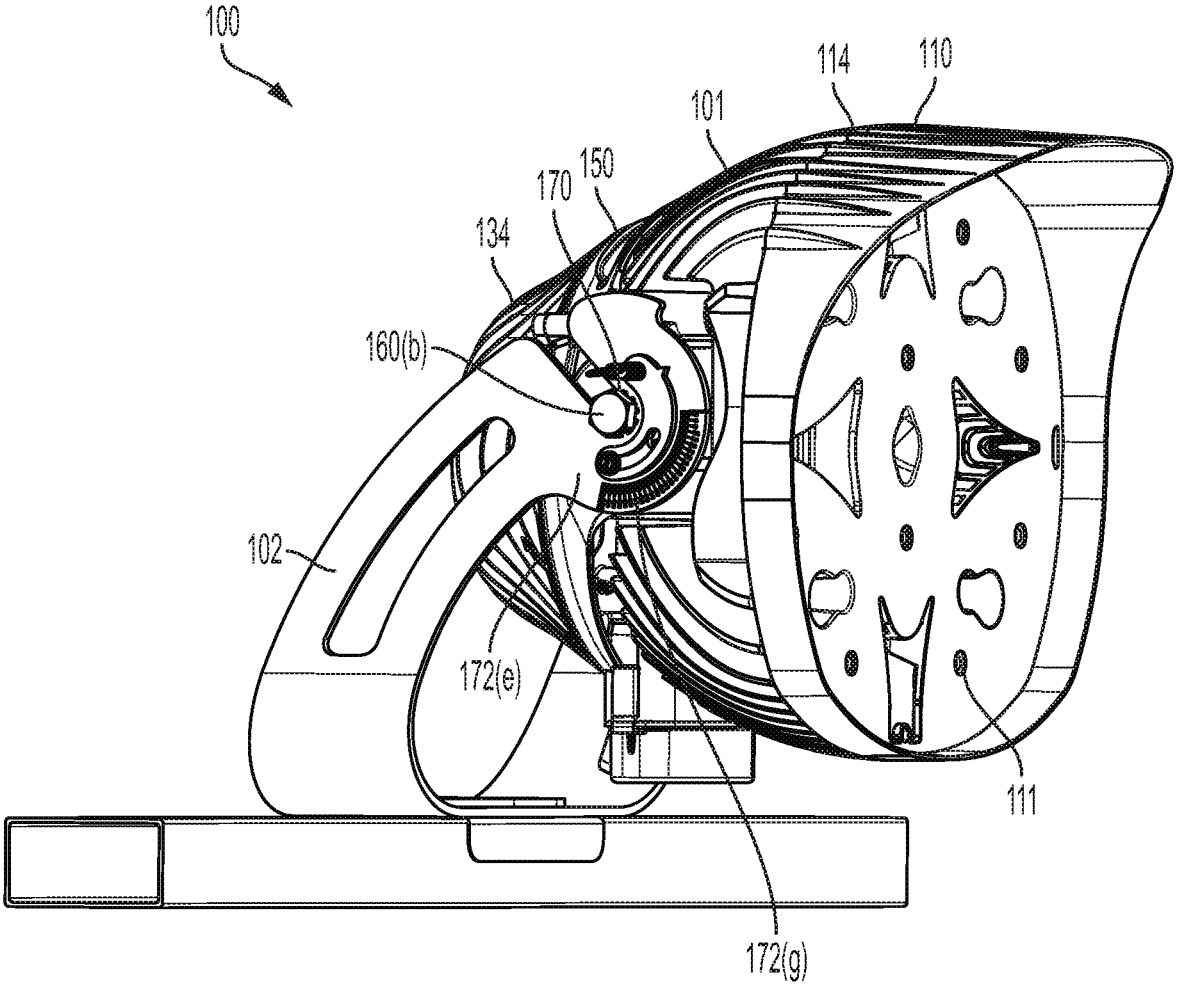
FIG. 1B illustrates a right perspective view of the example lighting device of FIG. 1A.
Figure 1C:
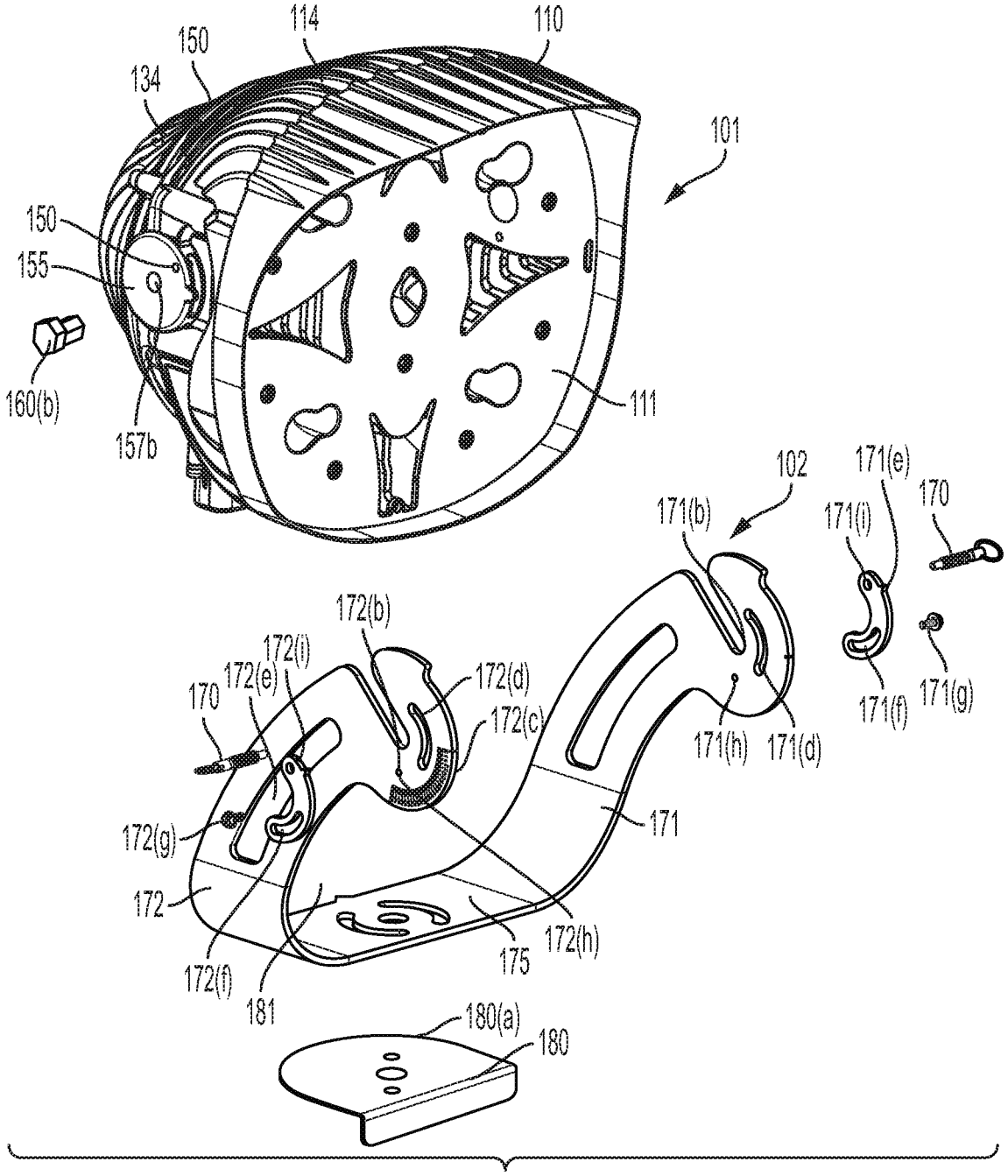
FIG. 1C illustrates an exploded view of the example lighting device of FIG. 1B.

FIG. 1A illustrates a left perspective view of an example lighting device 100 that includes a mounting structure for accurate aiming of the lighting device, while FIG. 1B illustrates a right perceptive view of the example lighting device 100. FIG. 1C illustrates an exploded view of the example lighting device 100 of FIG. 1A. The lighting device 100 may include a light fixture 101 pivotably mounted on a mounting structure 102 in a pre-aimed configuration. The mounting structure 102 may be affixed to a support structure (e.g., a pole, ceiling, overhead rods, etc.) in a suitable configuration to provide a desired light output pattern from the light fixture 101 in a desired direction.

The light fixture 101 may include a housing 110, an interface plate 150, and an optional power supply unit 134. In one or more embodiments, the housing 110 may encase various components of the light fixture. Specifically, the housing 110 may include an opening 111 in which a set of LED modules (not shown here) are secured to form a multi-module LED structure (e.g., front section). The LED modules may be positioned to emit light away from the light fixture 101. Each LED module may include one or more LEDs arranged in an array or other configuration. In various embodiments, the number of LEDs in each module may be any number that is sufficient to provide a high intensity LED device. Each LED module will also include a substrate on which the LEDs, various conductors and/or electronic devices, and/or optical elements (e.g., lenses) for the LEDs are mounted.

The opening 111 of the housing 110 may be circular, square, diamond-shaped with round corners (as shown in FIGS. 1A and 1B), although other shapes are possible. In certain embodiments, the light fixture 101 may include five LED modules as shown, with four of the modules positioned in a quadrant of the opening 111 and the fifth module positioned in the center as shown. Alternatively, any other number of LED modules, such as one, two, three, four or more LED modules, may be positioned within the opening 111 in any configuration.

The housing 110 may also include a body portion 114 (e.g., rear section). The body portion 114 may be configured to serve as a heat sink that dissipates heat generated by the LED modules. For example, the body portion 114 may include any number of fins 131 on the exterior to increase its surface area that will contact a surrounding cooling medium (typically, air) to serve as a heat sink. In some embodiments, the body portion 114 may be formed of aluminum and/or other metal, plastic or other suitable material. In an example embodiment, the body portion 114 or the entire housing 110 may have a bowl shape (as shown in FIGS. 1A, 1B, and 1C), the LED modules may fit within the opening 111 of the bowl, and heat from the LED modules may be drawn away from the LED modules and dissipated via the fins 131 on the exterior of the bowl.

While the LED modules are positioned at the front of housing 110, the opposing side of the body portion 114 may be connected to a power supply unit 134. In some embodiments, the body portion 114 may be connected to the power supply unit 134 via an optional thermal separation plate (not shown here). The thermal separation plate separates the power supply unit 134 from the heat sink body 114. The thermal separation plate may be made of materials that help shield the LED modules from heat generated by the power supply 134. Such materials may include, for example, aluminum, plastic, ceramic, carbon fiber, composite materials or other materials. In certain embodiments, the interface plate 150 may be configured to function as a thermal separation plate.

The power supply unit 134 may include a battery, solar panel, or circuitry to receive power from an external and/or other internal source. The interior of the power supply unit 134 may include wiring or other conductive elements for the LED modules. The power supply unit 134 may be positioned at or near the rear of the body 114 as shown, or it may be placed into the housing 110 so that it is flush or substantially flush with the rear of the body 114, or it may be configured to extend to some point between being flush with the body portion 114 and an extended position. Other positions of the power supply unit 134 are within the scope of this disclosure.

In certain embodiments, the power supply unit 134 may be detachable from the housing 110 so that it can be replaced and/or removed for maintenance without the need to remove the entire lighting device 100 from an installed location, or so that it can be remotely mounted to reduce weight of the housing 110. The power supply unit 134 and/or a portion of the housing 110 may include one or more antennae, transceivers or other communication devices that can receive control signals from an external source. For example, the lighting device 100 may include a wireless receiver and an antenna that is configured to receive control signals via a wireless communication protocol.

The housing 110 may be formed as a single piece, or it may be formed of two pieces that fit together as in a clamshell-type structure. In a clamshell design, a portion of the interior wall of the clamshell near its opening 111 may include a groove, ridge, or other supporting structure that is configured to receive and secure the LED modules in the opening 111 when the clamshell is closed. In addition, the fins 131 may be curved or arced as shown, with the base of each fin's curve/arc positioned proximate the opening/LED modules 111, and the apex of each fin's curve/arc positioned distal from the opening/LED modules 111, to further help draw heat away from the LED modules.

The light fixture 101 may also include an interface plate 150 for affixing to and/or interfacing with the mounting structure 102 of the lighting device 100. In certain embodiments, the interface plate 150 may be disposed between the power supply unit 134 and the housing 110 (as shown in FIG. 1C). However, the interface plate 150 may be positioned at other suitable places within the light fixture 101 (e.g., in the body portion 114 of the housing). In certain embodiments, the mounting fixtures of the interface plate 150 (e.g., apertures described below) may be cast directly into the housing 110 and/or the power supply unit 134.

Figure 2A:
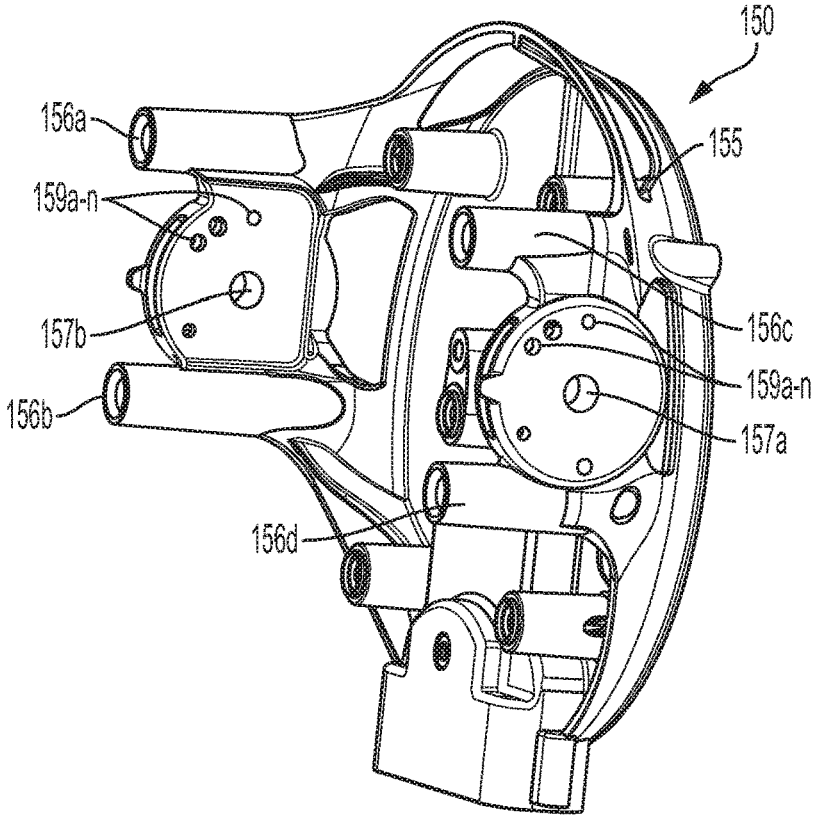
FIGS. 2A and 2B illustrate different perspective views of an example interface plate of a light fixture.
Figure 2B:
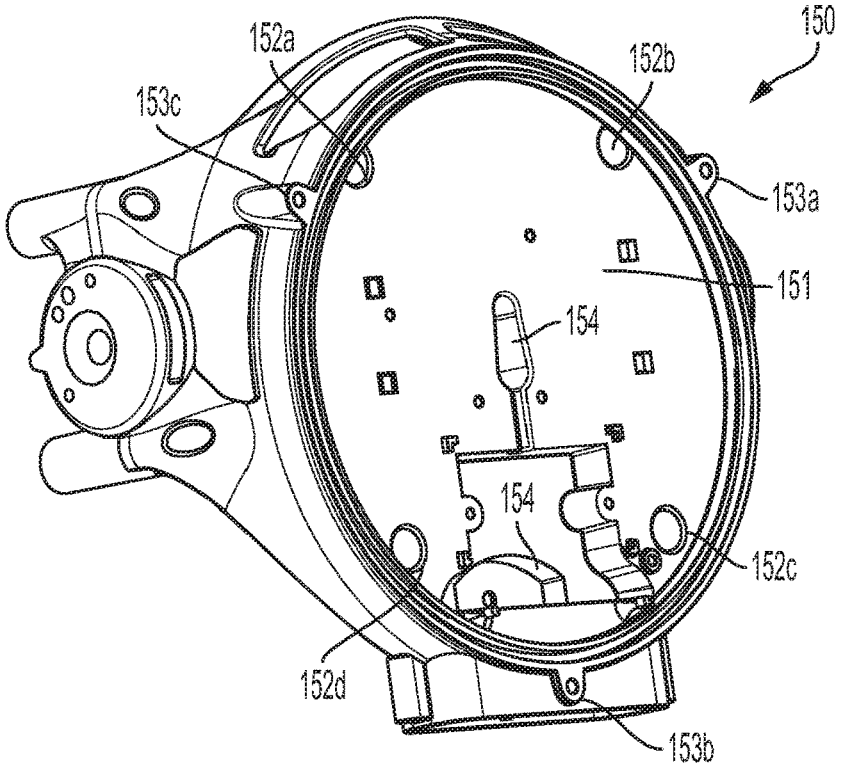

FIGS. 2A and 2B illustrate different perspective views of an example interface plate 150. As shown in FIG. 2, the interface plate 150 may be a one piece structure that includes a central planar portion 151 and a peripheral portion 155, although any suitable geometry is contemplated. In certain embodiments, the central planar portion 151 may be disposed between the rear of the housing 110 and the power supply unit 134. The central planar portion 151 may include a plurality of apertures (e.g., threaded apertures) to facilitate secure attachment of the interface plate 150 to the housing 110 and/or the power supply unit 134. For example, as shown in FIG. 2, apertures 152*a-d* may lockably engage screws for attachment to the housing 110, and apertures 153*a-c* may lockably engage screws for attachment to the power supply unit 134. While the current disclosure describes attachment of the interface plate 150 to the housing 110 and/or the power supply unit 134 using screws, the disclosure is not so limiting, and other suitable attachment methods (e.g., adhesives, mounting pins, fasteners, nuts and bolts, tethers, hooks, welding, forming as a single part, etc.) are within the scope of this disclosure. Referring back to FIG. 2, the central planar portion 151 may also include one or more through apertures 154 for routing one or more wires, cables, or other circuit elements to between the power supply unit 134 and the housing 110, LED modules or other components of the lighting device 100.

As shown in FIG. 2, the interface plate 150 also includes peripheral portion 155 surrounding the central planar portion 151. The peripheral portion 155 may optionally include additional screw apertures 156*a-d* for aiding in attachment of the interface plate 150 to the housing 110 and/or the power supply unit 134.

The peripheral portion 155 may also include mounting apertures 157*a* and 157*b* (e.g., a threaded aperture) positioned at diametrically opposite ends of the interface plate 150 (along the tilt axis). In certain embodiments, the tilt axis may be an axis along which the light fixture 101 may be tilted (e.g., the equatorial X-X axis) in the vertical direction (i.e., the Y-direction) when mounted on a mounting structure 102, to enable the light fixture 101 to be positioned to direct light at a desired angle. Specifically, rotation or pivoting of the light fixture 101 along the tilt axis adjusts the aim of the light fixture 101. The mounting apertures 157*a* and 157*b* may be configured to receive a mounting element 160 (as shown in FIGS. 1A, 1B and 1C). Mounting elements 160*a* and 160*b* threaded or otherwise inserted into mounting apertures 157*a* and 157*b* may be used for pivotably mounting the housing 110 on the mounting structure 102 (as described below). An optional washer (not shown here) may be sandwiched between the head of the mounting element 160 and the corresponding aperture to prevent unintentional rotation, picoting or movement of the light fixture 101. The mounting apertures 157*a* and 157*b* may be positioned to be in line with the tilt axis to allow for rotation of the light fixture 101 along the tilt axis when the mounting elements 160*a* and 160*b* are loosened. Examples of mounting elements may include, without limitation such as a pin, a screw, a bolt, threading, or the like. The use of a mounting element inserted into an aperture in the interface plate is for example purposes only and other structures such as rod shaped protrusions formed as part of the interface plate (e.g., by molding) may be similarly used.

The peripheral portion 155 may also include a plurality of tilt apertures 159*a*, 159*b*, 159*c* . . . 159*n* (three shown here) formed around each of the mounting apertures 157*a* and 157*b* for receiving a fastening device 170 (discussed below in more detail). The location of each of the plurality of tilt apertures 159*a*, 159*b*, 159*c* . . . 159*n* may correspond to a tilt angle or rotation angle (in a decreasing or increasing order) of the light fixture 101 along the tilt axis and with respect to the mounting structure 102. The tilt apertures permit a wide range of orientations—adjustable in small increments—which is well suited to the aiming needs of lighting devices. As discussed below in more detail, the mounting structure 102 includes complementary mounting ends with semi-circular (or arcuate) slots for fixing the orientation or tilt angle of the light fixture 101. In certain embodiments, the peripheral portion may include a single tilt aperture 159 (as shown in FIG. 1C), such that when the fastening device 170 is threaded through the tilt aperture 159, the light fixture 101 is mounted at a desired tilt angle with respect to the mounting structure 102. The location of the tilt aperture 159 may be determined based on the desired aiming angle.

Referring back to FIGS. 1A, 1B and 1C, the light fixture 101 may be pivotably mounted on the mounting structure 102. Specifically, the light fixture 101 may be pivoted or tilted about an axis to adjust the vertical aiming angle (or tilt or pitch) when mounted on the mounting structure 102. The mounting structure 102 may be made of a rigid material such as, without limitation, metal, plastic, ceramic, carbon fiber, composite materials or other materials. For example, the mounting structure 102 may be made of steel, aluminum, or the like.

Figure 3:
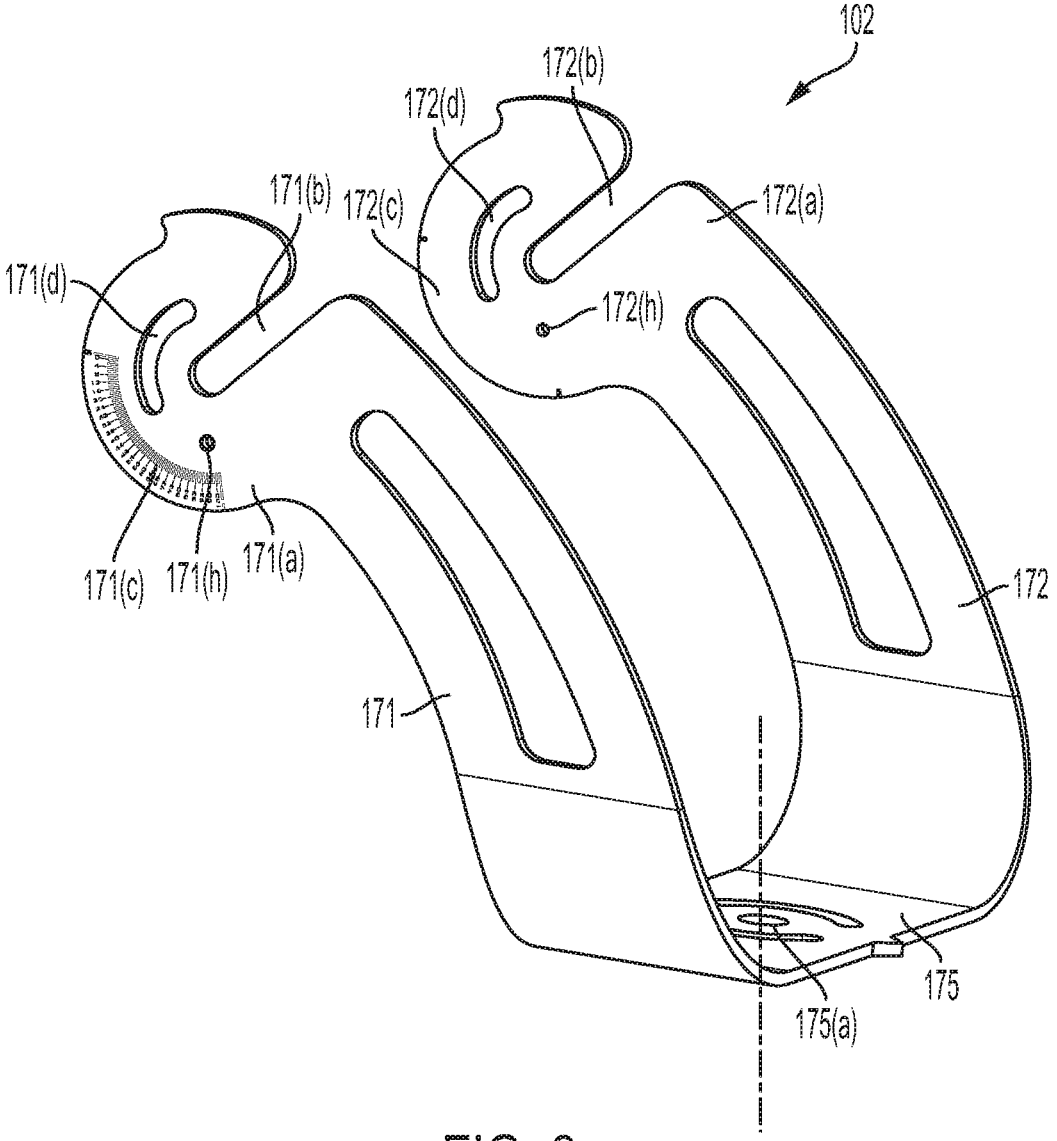
FIG. 3 illustrates a perspective view of an example mounting structure.

As shown in FIG. 3, the mounting structure 102 may be include two upstanding arms 171 and 172 that are attached to a base 175 at one end, and are configured for attachment to the light fixture 101 at the other end (i.e., the mounting ends 171(*a*) and 172(*a*)). Specifically, the light fixture 101 is mounted between the upstanding arms 171 and 172 of the mounting structure 102. The two arms may be arc shaped (as shown in FIG. 3), straight, or any other suitable geometry, and may be disposed at any suitable angle with respect to the base 175.

Each mounting end 171(*a*) and 172(*a*) of the arms 171 and 172 may include a U-shaped mounting slot 171(*b*) and 172(*b*) that engages with a corresponding mounting element 160*a* and 160*b* (threaded into mounting apertures 157*a* and 157*b*, respectively) when the light fixture 101 is pivotably mounted on the mounting structure 102. Other shapes of the mounting slots 171(*b*) and 172(*b*) are within the scope of this disclosure such as, without limitation, V-shaped, C-shaped, or the like.

Each mounting end 171(*a*) and 172(*a*) may also include an angular scale (e.g., a protractor) 171(*c*) and 172(*c*) that may be cast or imprinted. The angular scales 171(*c*) and 172(*c*) may have markings for angles in the range of about 0° to about 180°, marking for various vertical aiming angles available for the lighting device 100, markings for various vertical aiming angle ranges, or the like. Each mounting end 171(*a*) and 172(*a*) a semi-circular slot 171(*d*) and 172(*d*) configured to receive a fastening device 170. In certain embodiment, the length of each semi-circular slot 171(*d*) and 172(*d*) corresponds to the range of tilt angles (or pivoting range) allowed for the light fixture 101 along the tilt axis. Specifically, one end of a semi-circular slot aligns with the lowest tilt angle of the lighting fixture 101 (i.e., tilt aperture 159*a*) and the other end aligns with the highest tilt angle of the lighting fixture 101 (i.e., tilt aperture 159*n*). Alternatively, if the peripheral portion 155 includes only one tilt aperture 159, the tilt aperture 159 may be positioned to fall such that it aligns with a portion of the semi-circular slots 171(*d*)/172(*d*).

The base 175 of the mounting structure 102 may be configured for attachment to a support structure (not shown here) such as, without limitation, a light pole, a cross arm of a light pole, a ceiling, a wall, mounted support structures (e.g., overhead brackets, etc.), or the like. In certain embodiments, the base 175 may be attached to the support structure to allow for rotation of the lighting device 100 in the horizontal direction (i.e., the horizontal aiming angle or yaw may be adjusted). For example, the base 175 may be attached to the support structure by threading a fastening device (e.g., screw, bolt, etc.) through aperture 175(*a*) in a manner that allows the base to rotate along an axis that is concentric with the aperture 175(*a*). Alternatively, the fastening device may be tightened to prevent rotation. The base may also include a bracket 180 welded or otherwise attached to the base 175. The bracket 180 may be configured to adjust the rotational angle of the light fixture 101 mounted on the mounting structure 102 with respect to the support structure. For example, an angular scale 180(*a*) (similar to angular scale 171(*c*)) may be printed or otherwise formed on the bracket 180, and a pointer 181 may be used to set the horizontal aiming angle (i.e., rotational angle) of the light fixture 101.

Figure 4:
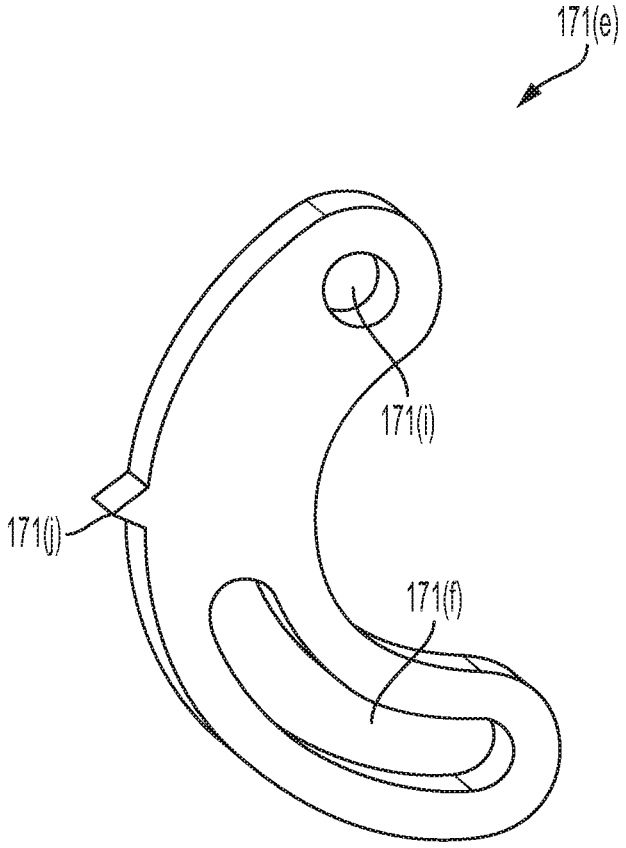
FIG. 4 illustrates a perspective view of an example locking plate

Referring back to FIGS. 1A, 1B and 1C, in certain embodiments, an optional C-shaped locking plate 171(*e*) and 172(*e*) may be affixed to the outside (i.e., the side facing away from the light fixture 101) of the mounting ends 171(*a*) and 172(*a*). FIG. 4 illustrates a perspective view of a locking plate. The locking plates 171(*e*) and 172(*e*) may also include a semi-circular slot 171(*f*) and 172(*f*) for receiving screws 171(*g*) and 172(*g*) that can be lockably engaged into the suitable apertures 171(*h*) and 172(*h*) provided in the mounting ends 171(*a*) and 172(*a*). The locking plates 171(*e*) and 172(*e*) may rotate about the screws 171(*g*) and 172(*g*), respectively, between the ends of the corresponding semi-circular slots. The movement of the locking plates 171(*e*) and 172(*e*) may rotate about the screws 171(*g*) and 172(*g*) may be restricted by insertion of the fastening device 170 into apertures 171(*i*) and 172(*i*), respectively. The length of each semi-circular slot 171(*f*) and 172(*f*) corresponds to the range of tilt angles (or pivoting range) allowed for the light fixture 101 along the tilt axis. Each locking plate 171(*e*) and 172(*e*) may also include pointers 171(*j*) and 172(*j*) to the respective angular scales 171(*c*) and 172(*c*) configured to identify the current tilt angle of the light fixture 101. Examples of such pointers may include, without limitations, a notch (e.g., v-shaped or arrow shaped) formed in the locking plate, markings (e.g., arrows, lines, etc.) formed on the locking plate, protrusions in the locking plate (as shown in FIG. 3), or the like.

Each locking plate 171(*e*) and 172(*e*) may also include apertures 171(*i*) and 172(*i*) for receiving the fastening device 170. In certain embodiments, the fastening device 170 may be routed through the aperture 171(*i*) in the aiming plate and the semi-circular slot 171(*d*) in the mounting end 171(*a*) of the mounting structure 102, before lockably engaging with the appropriate tilt aperture 159 or 159*a-n* (selected based on the desired vertical aiming angle) of the interface plate 150 of the light fixture 101 (similarly through aperture 172(*i*) in the aiming plate and the semi-circular slot 172(*d*), and corresponding tilt aperture). Once the fastening device(s) are lockably engaged with the appropriate tilt aperture(s), the light fixture 101 is oriented to direct light at the desired vertical aiming angle, and the locking plate pointers 171(*j*) and 172(*j*) may be used to determine the vertical aiming angle. Further pivoting or rotation of the light fixture 101 with respect to the mounting structure 102 is not allowed. Once aimed, the mounting elements 160*a* and/or 160*b* may also optionally be tightened in place so that the correct vertical aiming position or orientation for the light fixture 101 is set.

Finally, changes in the orientation or tilt of the light fixture 101 may be accomplished simply by withdrawing the fastening device(s) from the current tilt aperture(s), and lockably engaging it with another tilt aperture(s) corresponding to the new aiming angle. In certain embodiment, the mounting element(s) 160*a* and/or 160*b* may need to loosened for changing the orientation.

Examples of the fastening device 170 may include, without limitation, a spring pin, friction-fit barb, a friction-fit notch, a spring-pin barb, a ball and socket, a screw-thread, or other positioning mechanism, that allow for lockable engagement with apertures in the interface plate 150 for configuring the aiming angle or tilt of the light fixture 101.

The embodiments of the current disclosure provide or enhance the ability to set or pre-aim a light fixture of a lighting device at the factory relative to a particular location or application. The light fixture may be easily pre-aimed at a desired orientation—vertical aiming angle (tilt) and/or horizontal aiming angle (yaw) which may be determined based on the intended mounting positions of the fixtures. For example, the aiming angle may be determined based on the type of lighting device and number/nature of light sources contained therein. Different pole locations and heights will require different aiming angles so to adequately light the target area. For example in a sports field, the poles near the outfield may require the largest pan (i.e., horizontal aiming angle), and any array of lighting fixtures (or fixture within an array) aimed to light a portion of the target area near the base of its own pole will require the largest tilt (i.e., vertical aiming angle).

In certain embodiments, the mounting structure and the light fixture may be separately shipped to the installation site and the fastening device may be used for pre-aiming of the light fixture. During pre-aiming, the fastening device 170 may be lockably engaged with the appropriate semi-circular slot 171(*d*) and 172(*d*) of the mounting bracket 102 at a location corresponding to the desired tilt angle of the lighting device. For example, if the fastening device 170 is a spring pin, it may be locked at the desired position in the semi-circular slot 171(*d*) and 172(*d*). During installation, if the interface plate 150 includes only one tilt aperture 159, the fastening device 170 may simply snap into the tilt aperture 159 at the desire tilt angle. Alternatively, if the interface plate includes multiple tilt apertures 159*a-b*, the tilt angle may further be adjusted at the installation site based on a selection of the tilt aperture for receiving the fastening device.

Similarly, the bracket at 180 at the base 175 may also be fixed at a pre-aimed rotation angle.

Figure 5:
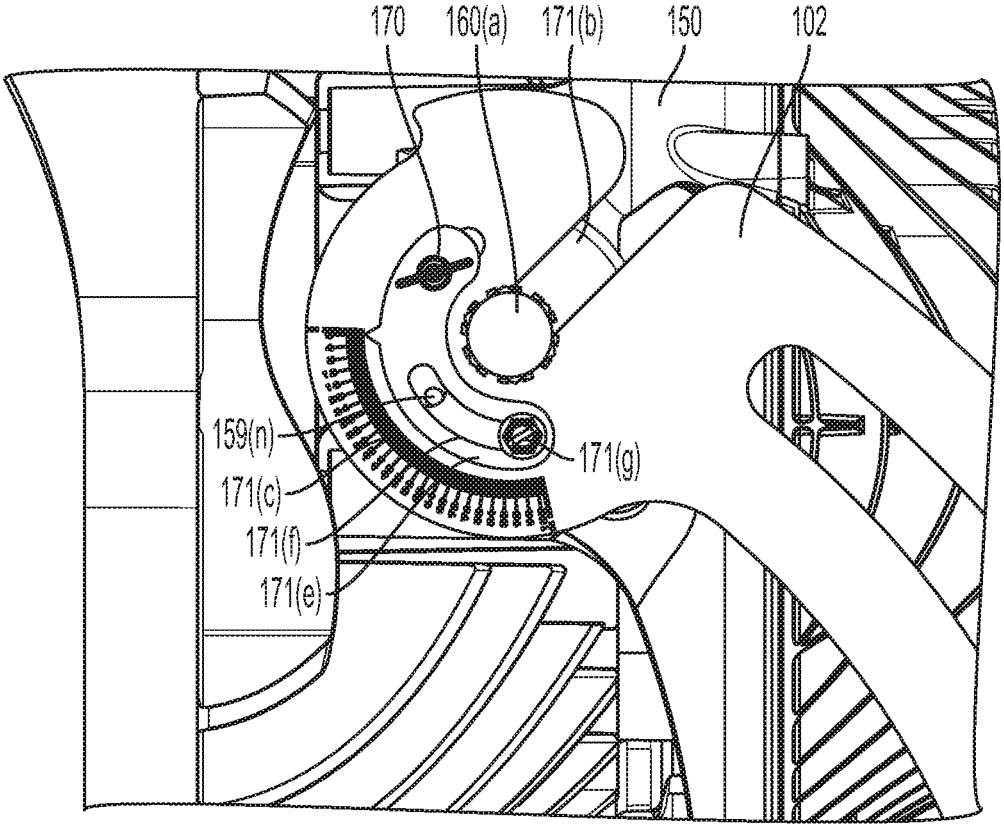
FIG. 5 illustrates a close-up view of the locking plate when the light fixture is mounted on the mounting structure.

Thus, an installer of the lighting device 100 can have a factory-preset correct aiming angle of the light fixture 101 (for example, as shown in FIG. 5). This avoids individual aiming of a light fixture when the lighting device 100 is installed at the field. Additionally, it allows easier maintenance. For example, the lighting device 100 may be removed from the support structure for maintenance and re-installed post maintenance without the need for realignment or re-aiming. Furthermore, the worker knows the fixture will be back in exact aiming position if the locking plate pointers 171(*j*) and 172(*j*) have not moved (i.e., the aiming angle determined using the position of the locking plate pointers 171(*j*) and 172(*j*) remains the same), and thus does not have to re-aim or verify aiming.

Furthermore, each individual lighting device, according to embodiments of the present disclosure, may be a part of an array of lighting devices all of which may be pre-aimed individually as part of a lighting design before actual installation (e.g., during manufacture or assembly process). Such pre-aimed lighting devices may then be installed in a specific location, the light fixture of the lighting device itself being oriented (or pre-aimed) on site according to the lighting design plan. Such pre-aiming does not require cumbersome and costly on-site aiming and calibration of the lighting devices, and is more accurate.

Finally, the orientation of a lighting device may be accurately and easily changed (for e.g., if the location of the lighting device is changed) by re-engagement of the fastening device with a new tilt aperture. Therefore, the light fixtures can be re-aimed at the factory as well as in-situ.

It should be noted that while the above disclosure describes the mounting structure 102 as having two upstanding arms, the disclosure is not so limiting. In certain embodiments, the mounting structure 102 may include only one arm (and corresponding components) thus having an overall L-shape. Other shapes and configurations are within the scope of this disclosure.

Figure 6A:
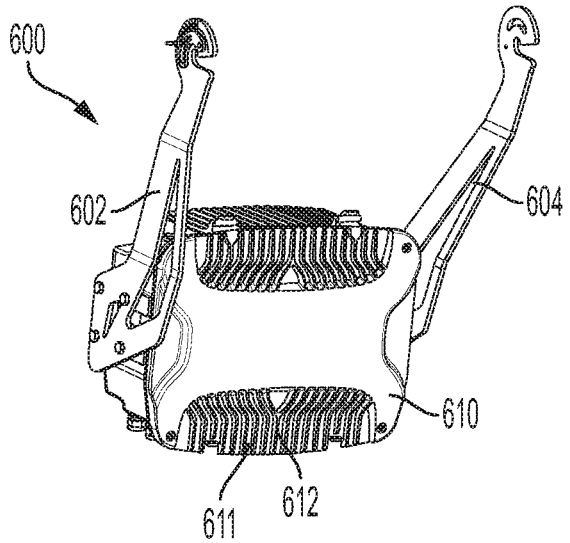
FIG. 6A illustrates an alternate embodiment of an example mounting structure.
Figure 6B:
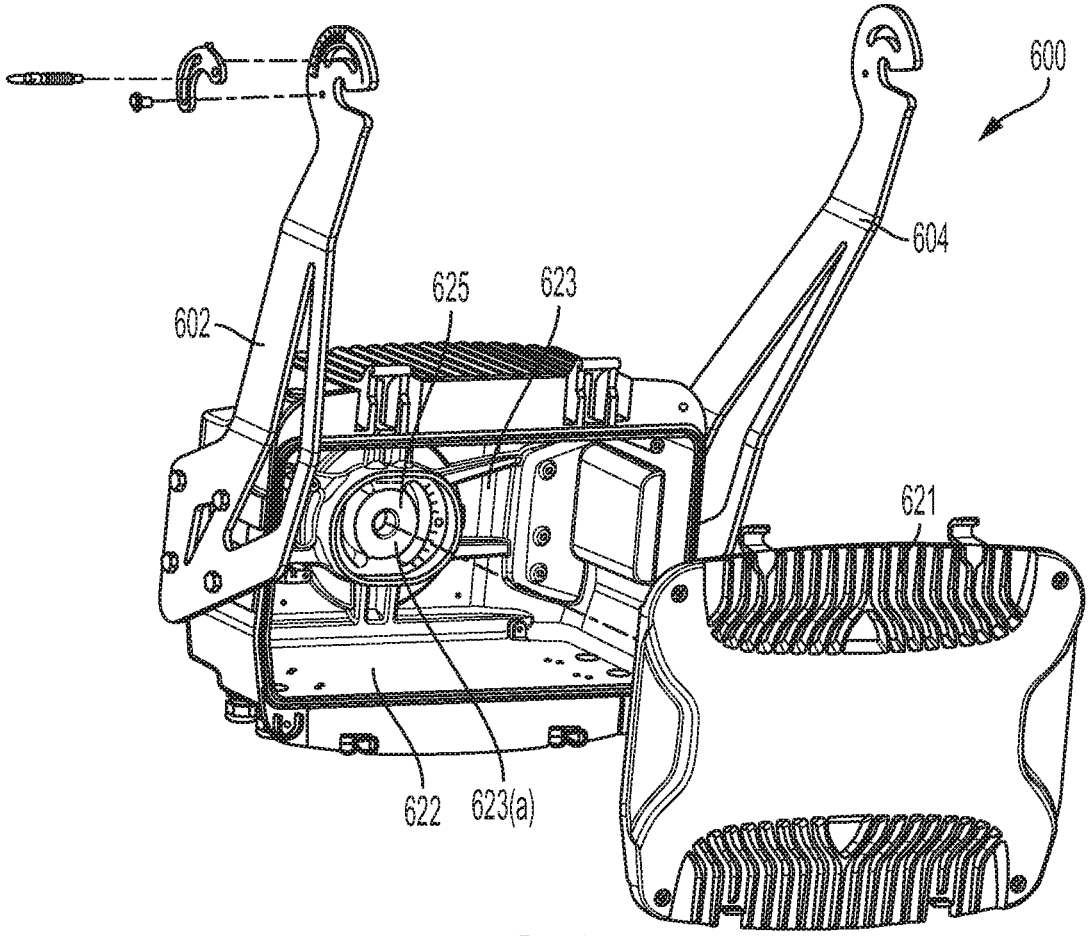
FIG. 6B illustrates an exploded view of the alternate embodiment.

Furthermore, while the above disclosure describes the power supply as being included in the light fixture, in certain scenarios, the power supply may additionally and/or alternatively be attached to the mounting structure (as shown in FIGS. 6A and 6B). FIG. 6A illustrates a mounting structure 600 that includes the arms 602 and 604 (identical to the arms 171 and 172 described above). However, instead of a base, a power supply (or driver box) 610 may be mounted between the two arms 602 and 604 at the ends opposite to the light fixture receiving end 602(*a*) and 604(*a*). The power supply 610 may be mounted between the two arms 602 and 604 using any now or hereafter known methods that do not allow relative movement.

Furthermore, as shown in FIGS. 6A and 6B, the housing 611 of the power supply 610 may be configured to serve as a heat sink that dissipates heat generated by the components of the power supply 610. For example, the housing 611 may include any number of fins 612 (in any configuration and orientation) on the exterior to increase its surface area that will contact a surrounding cooling medium (typically, air) to serve as a heat sink. In some embodiments, the housing 611 may be formed of aluminum and/or other metal, plastic or other suitable material.

As shown in FIG. 6B, the power supply housing 611 may include a chamber 622 configured to receive one or more components (not shown here) of the power supply 610. The chamber may include a removable top lid portion 621 that may be opened to access the interior of the chamber 622. The top lid portion 621 may be secured in place to protect the components of the power supply 610. At least one surface (e.g., bottom surface 623) surface of the chamber 622 that interfaces with a support structure (e.g., a cross arm) when a light fixture is mounted on the support structure via the mounting structure 600 may be configured for attachment to the support structure. In certain embodiments, power supply 610 may be attached to the support structure to allow for rotation of the light fixture in the horizontal direction (i.e., the horizontal aiming angle or yaw may be adjusted). For example, the surface 623 may be attached to the support structure by threading a fastening device (e.g., screw, bolt, etc.) through aperture 623(*a*) in a manner that allows the power supply 610 and consequently the mounting structure 600 to rotate along an axis that is concentric with the aperture 623(*a*). Alternatively, the fastening device may be tightened to prevent rotation. The surface 623 may also include a bracket 625 (similar to bracket 180 welded or otherwise attached to the surface 623. The bracket 625 may be configured to adjust the rotational angle of the light fixture mounted on the mounting structure 600 with respect to the support structure. The bracket 625 by removal of the top lid portion 621.

The above-disclosed features and functions, as well as alternatives, may be combined into many other different systems or applications. Various presently unforeseen or unanticipated alternatives, modifications, variations or improvements may be made by those skilled in the art, each of which is also intended to be encompassed by the disclosed embodiments.

The invention claimed is:

1. A lighting device, comprising:

a light fixture, comprising:

a housing that contains one or more light emitting diode (LED) modules, and an interface plate comprising at least one tilt aperture adjacent to one or more end points of a tilt axis of the light fixture, the at least one tilt aperture corresponds to a tilt angle of the light fixture; and a mounting structure for pivotally mounting the light fixture, the mounting structure comprising:

an open-ended mounting slot for engaging with a mounting element of the interface plate, a semi-circular slot that overlaps the at least one tilt aperture when the light fixture is pivotally mounted on the mounting structure, and a fastening device that, when routed through a locking plate affixed to an outside surface of the mounting structure and through the semi-circular slot for insertion into the at least one tilt aperture, orients the light fixture pivotally mounted on the mounting structure at a tilt angle, wherein the fastening device is lockably engaged within the semi-circular slot at a position corresponding to the tilt angle.

2. The lighting device of claim 1, wherein the mounting structure further comprises:

a first mounting arm that is pivotally connected to a first side of the light fixture;

a second mounting arm that is connected to a second side of the light fixture; and a base that connects the first mounting arm to the second mounting arm and that is configured to attach the lighting device to a support structure.

3. The lighting device of claim 2, wherein the locking plate is affixed to an outside surface of either the first mounting arm or the second mounting arm.

4. The lighting device of claim 3, wherein the locking plate comprises a pointer for identifying the tilt angle of the light fixture pivotally mounted on the mounting structure by pointing to an angular scale included in the corresponding mounting arm.

5. The lighting device of claim 2, wherein the base is configured to attach to the support structure such that the lighting device may rotate with respect to the support structure.

6. The lighting device of claim 1, wherein the mounting structure extends beyond a rear section of the housing.

7. The lighting device of claim 1, wherein the fastening device comprises a spring pin.

8. The lighting device of claim 1, wherein the light fixture further comprises a power supply unit.

9. The lighting device of claim 8, wherein the interface plate is sandwiched between the housing and the power supply unit.

10. The lighting device of claim 1, wherein the mounting slot is a U-shaped slot.

11. The lighting device of claim 1, wherein the mounting element comprises at least one of the following:

a rod-shaped protrusion formed in the interface plate at an end point of the tilt axis of the light fixture; or a bolt inserted into a mounting aperture formed in the interface plate at an end point of the tilt axis of the light fixture.

12. A mounting structure for pivotally mounting a light fixture, the mounting structure comprising:

an open-ended mounting slot for engaging with a mounting element of the light fixture, a semi-circular slot that overlaps at least one of a plurality of tilt apertures of the light fixture when the light fixture is pivotally mounted on the mounting structure, and a fastening device that when routed through a locking plate affixed to an outside surface of the mounting structure and through the semi-circular slot for insertion into one of the plurality of tilt apertures orients the light fixture pivotally mounted on the mounting structure at a tilt angle corresponding to that tilt aperture.

13. The mounting structure of claim 12, further comprising:

a first mounting arm that is pivotally connected to a first side of the light fixture;

a second mounting arm that is connected to a second side of the light fixture; and a base that connects the first mounting arm to the second mounting arm and that is configured to attach to a support structure.

14. The mounting structure of claim 13, wherein the locking plate is affixed to an outside surface of either the first mounting arm or the second mounting arm.

15. The mounting structure of claim 14, wherein the locking plate comprises a pointer for identifying the tilt angle of the light fixture pivotally mounted on the mounting structure by pointing to an angular scale included in the corresponding mounting arm.

16. The mounting structure of claim 13, wherein the base is configured to attach to the support structure such that the light fixture may rotate with respect to the support structure.

17. The mounting structure of claim 12, wherein the fastening device comprises a spring pin.

18. A method for pre-aiming a lighting device comprises:

mounting a light fixture of the lighting device on a mounting structure through an open-ended mounting slot;

routing a fastening device through a locking plate affixed to an outside surface of the mounting structure and through a semi-circular slot in the mounting structure for insertion into one of a plurality of tilt apertures included in an interface plate of the light fixture, wherein each of the plurality of tilt apertures correspond to a tilt angle of the light fixture; and attaching the mounting structure with the mounted light fixture to a support structure.

* * * * *